US010236625B2

(12) United States Patent
Magness et al.

(10) Patent No.: US 10,236,625 B2
(45) Date of Patent: Mar. 19, 2019

(54) CABLE RETENTION DEVICE

(71) Applicant: OTTER PRODUCTS, LLC, Fort Collins, CO (US)

(72) Inventors: Cameron D. Magness, Fort Collins, CO (US); Lan Nguyen, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 48 days.

(21) Appl. No.: 15/792,107

(22) Filed: Oct. 24, 2017

(65) Prior Publication Data

US 2018/0131127 A1 May 10, 2018

Related U.S. Application Data

(60) Provisional application No. 62/418,646, filed on Nov. 7, 2016, provisional application No. 62/516,002, filed on Jun. 6, 2017.

(51) Int. Cl.

| | |
|---|---|
| ***H01R 13/60*** | (2006.01) |
| ***H01R 13/66*** | (2006.01) |
| ***H01R 13/52*** | (2006.01) |

(52) U.S. Cl.

CPC ..... *H01R 13/60* (2013.01); *H01R 13/5219* (2013.01)

(58) Field of Classification Search

CPC .... H01R 13/60; H01R 13/62; H01R 13/5219; H01R 13/5208; H01R 13/508; H01R 13/512; H01R 13/514; H01R 13/516; H01R 13/518; H01R 13/52; H01R 13/6392; H01R 13/6395; H01R 13/62933; H01R 13/5213; H01R 13/639; G11C 5/04

USPC ..... 439/527–534, 367–372; 174/135; 361/679.31

See application file for complete search history.

(56) References Cited

U.S. PATENT DOCUMENTS

| | | | | |
|---|---|---|---|---|
| 3,607,487 | A | 9/1971 | Biskeborn et al. | |
| 3,792,415 | A | 2/1974 | Fuller | |
| 3,953,098 | A | 4/1976 | Avery et al. | |
| 4,722,695 | A | 2/1988 | Zwicker et al. | |
| 4,795,857 | A | 1/1989 | McInnis | |
| 4,902,092 | A * | 2/1990 | Grandy | G02B 6/3807 385/101 |
| 5,683,273 | A * | 11/1997 | Garver | H01R 4/5025 174/84 R |
| 6,203,354 | B1 | 3/2001 | Kuwahara et al. | |
| 6,428,336 | B1 * | 8/2002 | Akerfeldt | H01R 12/63 439/263 |
| 6,600,109 | B1 * | 7/2003 | Andre | B65H 75/36 174/135 |
| 6,676,422 | B1 | 1/2004 | Baker et al. | |
| 7,214,075 | B2 * | 5/2007 | He | H01R 13/5213 439/135 |

(Continued)

*Primary Examiner* — Edwin A. Leon
*Assistant Examiner* — Milagros Jeancharles

(57) ABSTRACT

A retention device includes a ruggedized electrical cable including a first electrical connector at a first end and a second electrical connector at a second end, and a cap including a threaded interior for removably capturing the first electrical connector and the second electrical connector, wherein the threaded interior is configured to screw onto a corresponding threaded surface comprising the exterior of the first end and the exterior of the second end.

21 Claims, 9 Drawing Sheets

(56) References Cited

U.S. PATENT DOCUMENTS

| | | | | |
|---|---|---|---|---|
| 7,347,638 | B1 * | 3/2008 | Lin | B43K 27/00 340/321 |
| 7,775,834 | B2 * | 8/2010 | Zauber | H05K 7/1434 439/620.22 |
| 7,988,484 | B1 * | 8/2011 | Jacoby | H01R 13/6392 439/367 |
| 8,771,000 | B2 * | 7/2014 | Melni | H01R 4/56 439/271 |
| 8,853,542 | B2 | 10/2014 | Anderson et al. | |
| 9,106,003 | B2 | 8/2015 | Anderson et al. | |
| 9,130,300 | B2 | 9/2015 | Wu et al. | |
| 9,130,303 | B2 | 9/2015 | Anderson et al. | |
| 9,461,397 | B2 | 10/2016 | Feldmeier | |
| 2005/0178003 | A1 | 8/2005 | Torii et al. | |
| 2006/0204178 | A1 * | 9/2006 | Theuerkorn | G02B 6/3821 385/59 |
| 2007/0160327 | A1 * | 7/2007 | Lewallen | G02B 6/3817 385/53 |
| 2011/0256755 | A1 | 10/2011 | Montena | |
| 2014/0086534 | A1 * | 3/2014 | Lu | G02B 6/38 385/60 |
| 2015/0004814 | A1 | 1/2015 | Feldmeier | |
| 2015/0077919 | A1 * | 3/2015 | Chang | G11O 5/04 361/679.31 |
| 2016/0070313 | A1 * | 3/2016 | Wu | G06K 19/07732 361/679.32 |

* cited by examiner

CABLE RETENTION DEVICE

CROSS-REFERENCE TO RELATED APPLICATIONS

This application is related to U.S. Provisional Application No. 62/418,646, filed Nov. 7, 2016, and U.S. Provisional Application No. 62/516,002, filed Jun. 6, 2017, the disclosures of each of which are hereby incorporated by reference in their entirety.

BACKGROUND AND SUMMARY

Personal electronic devices are commonly used for communication, entertainment purposes, as well as Internet access and a variety of other purposes. Examples of personal electronic devices include smartphones, tablet computers, gaming devices, audio players, video players, cameras, portable computers, two-way radios, GPS receivers, and/or other portable devices. The devices often make use of electrical cables for one or more of a variety of purposes. Since the electrical cables are not always necessarily in use, users of the devices often misplace the cables, forget to take the cables with them, or end up in various situations where a cable is not available when needed. In one example, a user often does not have a charging cable for their smartphone with them when the device needs to be charged.

In one exemplary embodiment, a retention device is provided. The retention device includes a ruggedized electrical cable and a cap. The ruggedized electrical cable includes a first electrical connector at a first end and a second electrical connector at a second end. The cap is configured for removably capturing the first electrical connector and the second electrical connector to form a loop from the ruggedized electrical cable. The cap includes an attachment feature for attaching the cap to an object.

In another exemplary embodiment, a retention device is provided. The retention device includes a ruggedized electrical cable and a cap. The ruggedized electrical cable includes a first electrical connector at a first end and a second electrical connector at a second end. The cap includes a threaded interior for removably capturing the first electrical connector and the second electrical connector, wherein the threaded interior is configured to screw onto a corresponding threaded surface comprising the exterior of the first end and the exterior of the second end.

In another exemplary embodiment, a cable for transferring an electric signal is provided. The cable includes a first end and a second end electrically coupled to the first end. The first end includes a first threaded portion, a first alignment feature, and a first electrical connection. The second end includes a second threaded portion, a second alignment feature, and a second electrical connection. The cable has a first use configuration in which the first end is configured to be electrically coupled to a first external receiver and a the second end is configured to be electrically coupled to a second external receiver, the first alignment feature being spaced apart from the second alignment feature. The cable has a second lanyard configuration in which a threaded interior of a cap is removably coupled to the first and second threaded portions of the cable, the first end and the second end being positioned in an interior of the cap and the first alignment feature being adjacent to the second alignment feature in the second lanyard configuration.

DETAILED DESCRIPTION

Personal electronic devices have become ubiquitous and are used for a variety of purposes. Examples of personal electronic devices include smartphones, tablet computers, gaming devices, audio players, video players, fitness devise, medical devices, cameras, portable computers, two-way radios, GPS receivers, and/or other portable devices. Cables are often used with the types of devices. Cables includes power cables, data cables, combined power and data cables, charging cables, interface cables, Universal Serial Bus (USB) cables, LIGHTNING cables, proprietary cables, and/or combinations thereof. Users often don't have a cable with them when they need it, lose their cables, forget their cables, or otherwise don't think to bring their cable with them. Disclosed herein are various apparatuses which provide for more convenient carrying and use of electrical cables. While most of the examples herein are discussed with respect to cables used with personal or portable electronic devices, the improvements discussed herein may be implemented in conjunction with any type of cable.

Figure 1:
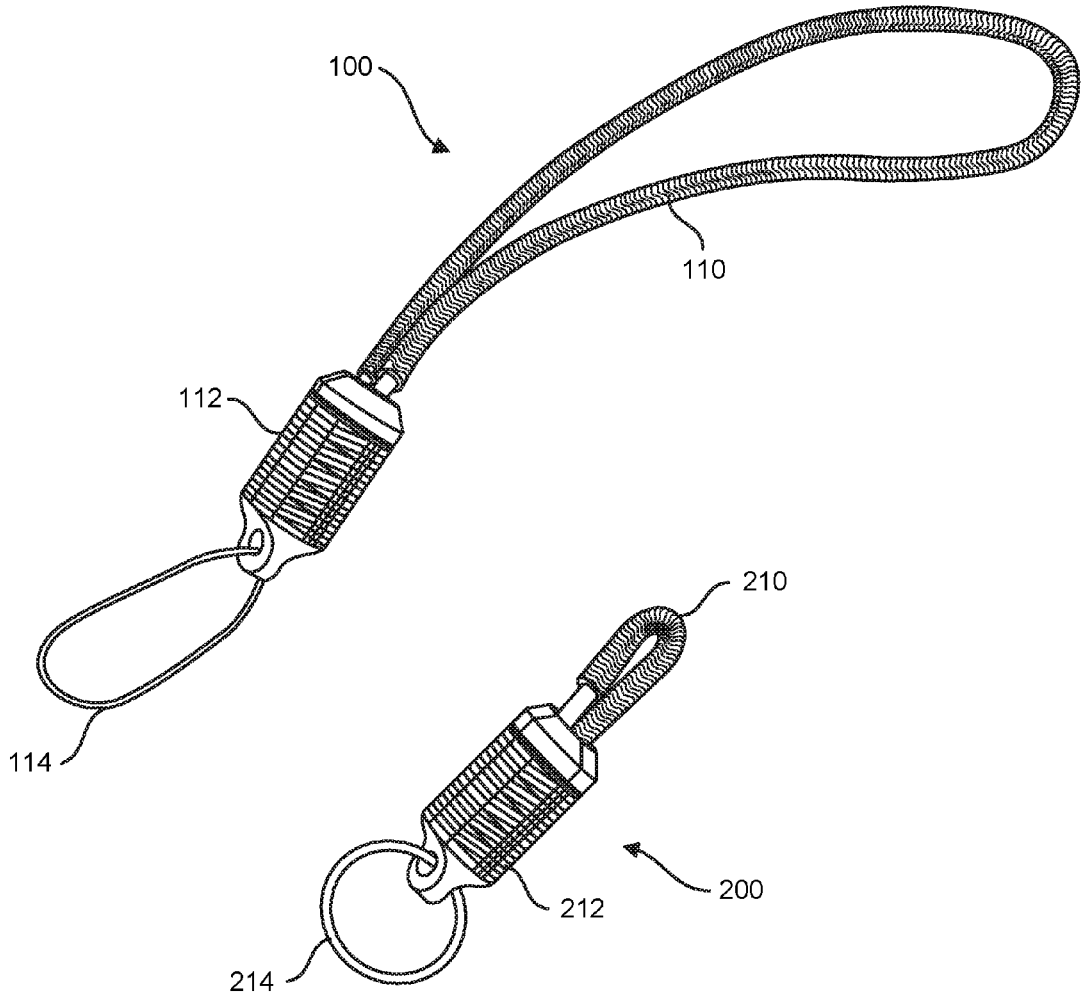
FIG. 1 illustrates exemplary retention devices with a lanyard and a keyring.

FIG. 1 illustrates a retention device 100 and a keyring 200. Retention device 100 comprises a cable 110, a cap or cover 112, and a lanyard 114. Cover 112 covers ends of cable 110 (discussed with respect to FIGS. 2A and 2B and not visible in FIG. 1). Cable 110 may be any type of electrical cable for use with a portable electronic device and/or for use with another type of device. In one specific example, cable 110 is a USB cable used for charging a smartphone. Cover 112 captures the ends of cable 110 (not visible in FIG. 1) and removably retains them together such that cable 110 forms a loop. The loop may be carried around a user's neck or wrist. The loop may also be looped over and/or attached to another object. Conveniently, cable 110 can be carried or attached in this way such that it is more readily available to a user when the user want to use cable 110. Cover 112 removably retains the cable ends to form the loop and also protectively covers the ends of cable 110 when they are not in use. In the configuration illustrated in FIG. 1, the first and second ends 118, 119 of cable 110 (not visible in FIG. 1 positioned adjacent each other within the interior of cap or cover 112.

Cable 110 may include or be covered with a resilient material, covering, mesh, jacket, or sheath to make it physically stronger, durable, ruggedized, waterproof, water resistant, and/or resistant to abrasion, cuts, or tears. In other words, cable 110 may include or may be covered with materials which make it better suited for use as a retention or carrying device while also protecting the electrical conductors and/or elements inside cable 110.

Retention device 100 also includes a lanyard 114. Lanyard 114 may be used for attaching to another device, such as to a personal electronic device or smartphone. In one specific example of use, lanyard 114 is attached to a smartphone or to a case for a smartphone such that the user can easily hang the smartphone around his or her neck using the loop formed by cable 100. In this way, cable 100 is readily available to the user when he or she needs it for charging or data communication purposes while also providing a convenient way to carry the device and avoid misplacing it. Retention device 100 may include one or more other attachment features, in addition to or in place of lanyard 114, for attaching to another object including. The other attachment feature(s) may include a hook and loop fastener, a magnet, a magnetic element, a screw, a nut, a snap, a clip, a quick-release mechanism, a spring loaded fastener, and/or the like.

FIG. 1 also illustrates keyring 200 which has features similar to retention device 100. Keyring 200 includes cable 210. Cable 210 is an example of cable 110, but may be shorter and/or not intended for hanging around a user's neck. Keyring 200 includes cover 212 which is an example of cover 112 and covers the ends (not visible in FIG. 1) of cable 210 when not in use. Keyring 200 also includes attachment feature 214 for attaching or carrying other objects, such as a split ring for carrying keys. While described as a 'keyring,' attachment to or use with many other types of objects besides keys are possible. Since a user commonly carries keys with them, keyring 200 makes cable 210 readily available whenever they have their keys with them.

Figure 2A:
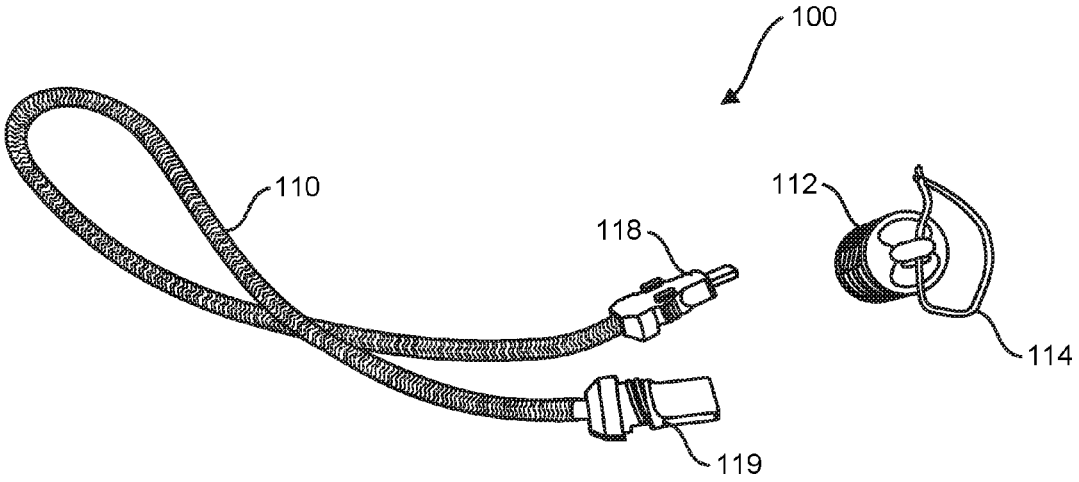
FIG. 2A illustrates the retention device with a lanyard of FIG. 1 in an open configuration.

FIG. 2A illustrates retention device 100 with cover 112 removed. With cover 112 removed, retention device 100 is shown in a use configuration in which first end 118 and second end 119 can be spaced apart from each other. Removing cover 112 exposes and releases first end 118 and second end 119 of cable 110 for use. First end 118 and second end 119 may each comprise any type of electrical and/or electromechanical connector and is not to be limited to any particular type of connector. First end 118 and/or second end 119 may include one or more different housings. In some examples, first end 118 and/or second end 119 may be a USB connector, a mini USB connector, a micro USB connector, a LIGHTNING connector, a proprietary connector, an auxiliary audio connector, and/or another type of connector. First end 118 and second end 119 may be the same type of connector as each other, may mate with each other, or may be different from each other. In the configuration shown in FIG. 2A, the connector of first end 118 or second end 119 may be coupled to a first receiver, such as a receiver associated with a personal electronic device or power management device, while the connector of the other of first end 118 and second end 119 is coupled to a second receiver, such as a receiver associated with another personal electronic device or power management device.

Figure 2B:
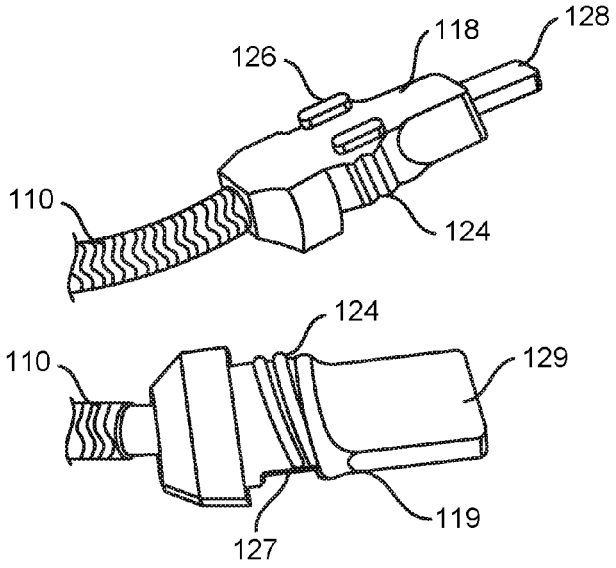
FIG. 2B illustrates a close-up view of a portion of FIG. 2A.

FIG. 2B illustrates a close up view of first end 118 and second end 119 of FIG. 2A. FIG. 2B further illustrates that first end 118 includes one or more electrical contacts 128 and second end 119 includes one or more electrical contacts 129. Electrical contacts 128 and 129 provide electrical connection to the electrical conducting elements of cable 110. Each of first end 118 and second end 119 include threads 124 such that when first 118 and second end 119 are seated next to each other the threaded portion of each together form a complete set of threads onto which cover 112 can be threaded and removably attached. When cover 112 is threaded onto the combined ends 118 and 119, ends 118 and 119 are held in place together to form the cable 110 loop illustrated in FIG. 1 until cover 112 is removed. In some examples, cover 112 may not be a threaded cover and may have other attachment features for removably snapping onto or over the cable ends.

Figure 2C:
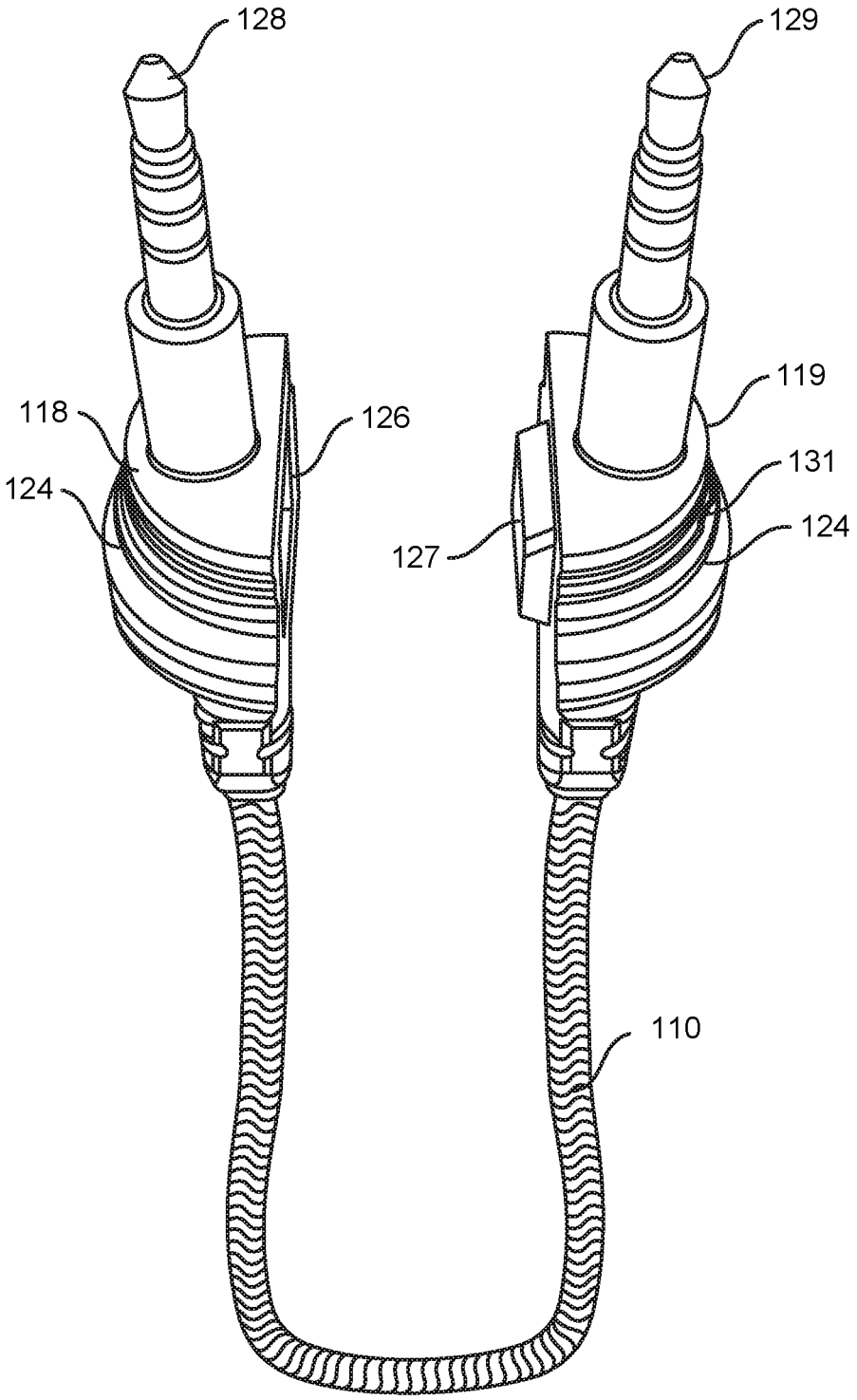
FIG. 2C illustrates an exemplary auxiliary audio cable.

FIG. 2C illustrates another exemplary cable 110 wherein the first end 118 and second end 119 each include an auxiliary connector, typically used for audio signals.

Cover 112 also protects the ends 118 and 119 from water, dust, dirt, moisture, mud, particles, impact, and/or other damage. In some situations, cover 112 may provide a watertight or waterproof seal such that ends 118 and 119 and/or electrical contacts 128 and 129 are protected from very wet and/or submerged conditions. In some configurations, the seal may be implemented with one or more gaskets or o-rings.

First end 118 and second end 119 may also include alignment features 126 and 127 for keeping them in position relative to each other when cover 112 is attached. Alignment features 126 and 127 may include a tab, a recess, a pin, a groove, a lip, a tooth, a finger, a slot, and/or any other features for keeping the two cable ends from moving relative to each other in one or more axes when they are placed next to each other. Alignment features 126 and 127 may keep the cable ends positioned relative to each other while cover 112 is being threaded onto threads 124. Once attached, cover 112 holds, along with alignment features 126 and 127, keeps the cable ends retained until cover 112 is removed.

Figure 3:
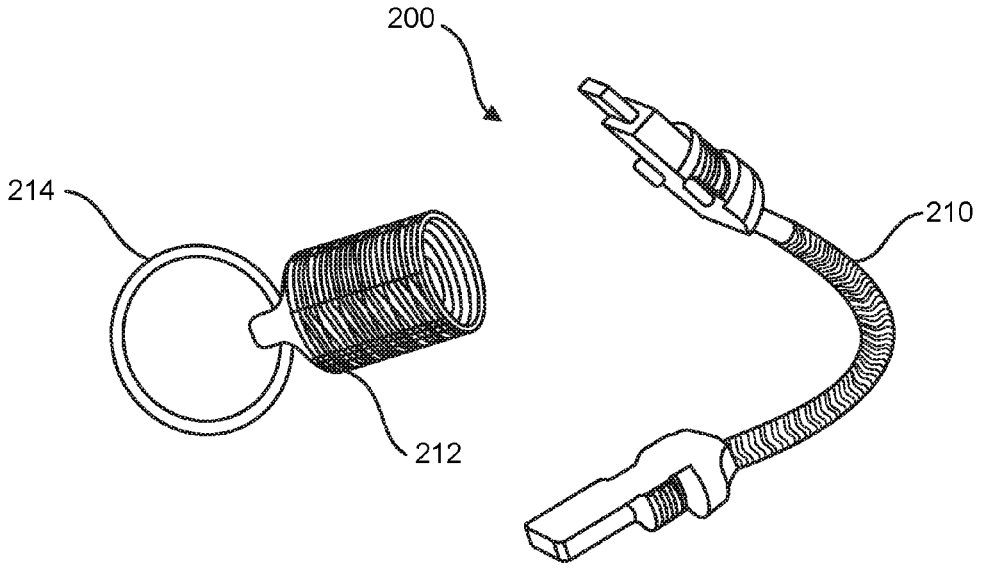
FIG. 3 illustrates the keyring of FIG. 1 in an open configuration.

FIG. 3 illustrates keyring 200 in an open position. Similar to the features described with respect to FIGS. 2A and 2B for retention device 100, cover 212 can be removed to expose the ends of cable 210 such that cable 210 can be used for electrical and/or data communication purposes. Any of the features in or discussed with respect to FIGS. 2A and 2B may be implemented in or used with keyring 200.

Figure 4:
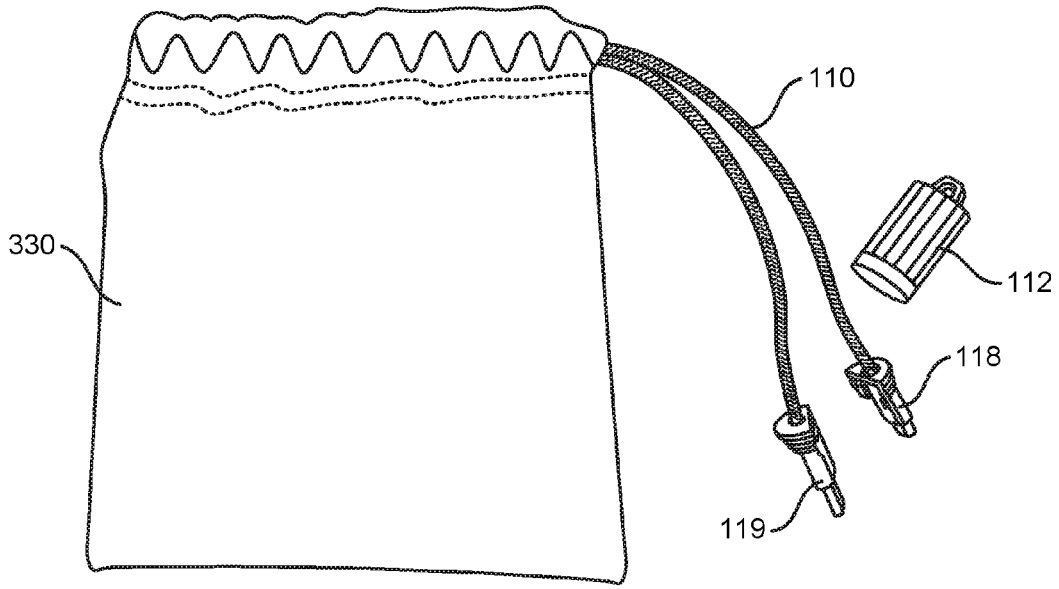
FIG. 4 illustrates use of a cable retention device for securing a container.

FIG. 4 illustrates use of a cable 110 for securing or closing a container 330. Container 330 may be any type of bag or other container which may benefit from cable 110 being used as a drawstring or closure device.

Figure 5A:
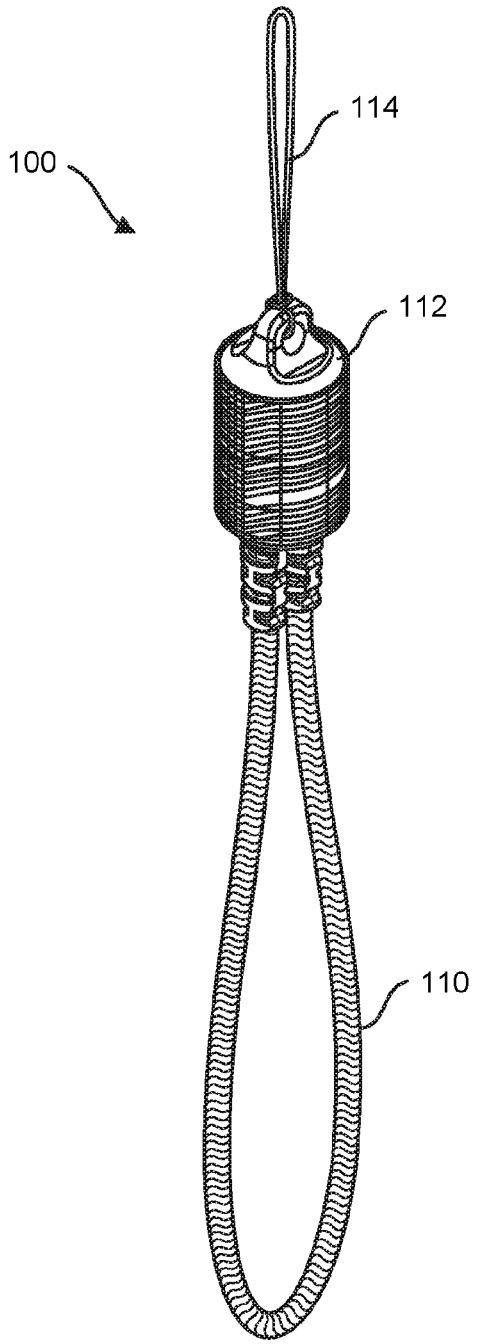
FIG. 5A illustrates another exemplary retention device in a closed configuration.
Figure 5B:
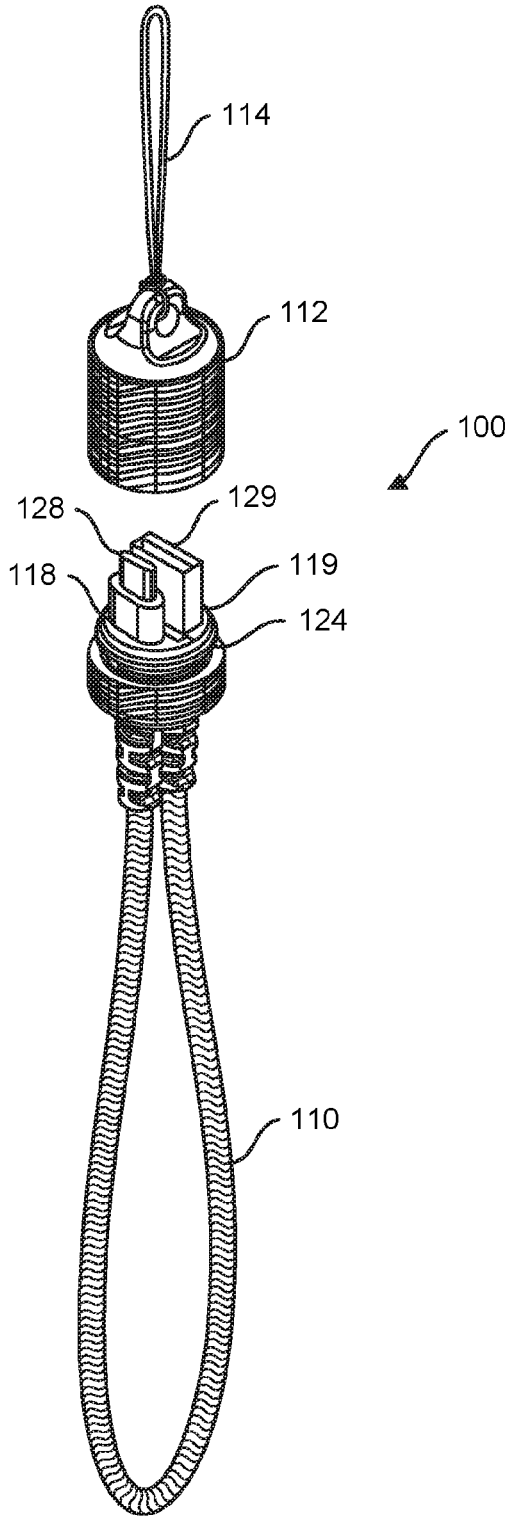
FIG. 5B illustrates an exploded view of the retention device of FIG. 5A.

FIGS. 5A and 5B illustrates another exemplary embodiment of a retention device 100. As shown in the closed configuration illustrated in FIG. 5A, the retention device 100 includes a cable 110 and a cap or cover 112 attached to a lanyard 114. As shown in FIG. 5B with the cover 112 removed, the cable 110 includes a first end 118 having one or more electrical contacts 128 and second end 119 having one or more electrical contacts 129. Strain relief may be provided between the cable 110 and the first end 118 and/or second end 119. Each of first end 118 and second end 119 include threads 124 such that when first 118 and second end 119 are seated next to each other the threaded portion of each together form a complete set of threads onto which cover 112 can be threaded and removably attached. When cover 112 is threaded onto the combined ends 118 and 119, ends 118 and 119 are held in place together to form the cable 110 loop illustrated in FIG. 5A until cover 112 is removed.

Figure 6:
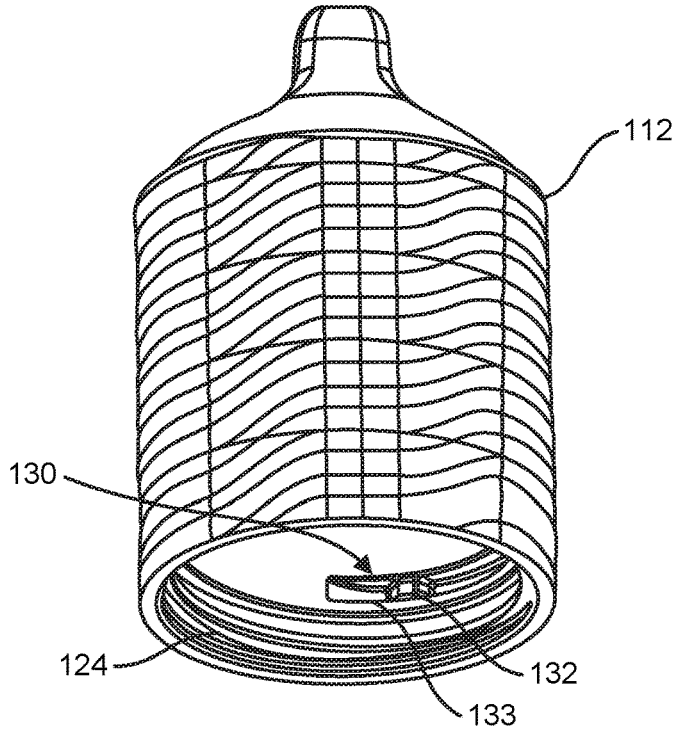
FIG. 6 illustrates a bottom perspective view of the cover of the retention device of FIG. 5A.

FIG. 6 illustrates a bottom perspective view of cover 112. The interior surface of cover 112 includes threads to mate with threads 124 of first end 118 and second end 119 when the cover 112 is screwed onto the cable 110 as illustrated in FIG. 5A. The threaded interior surface of cover 112 further includes cover securing portion 130.

Figure 7:
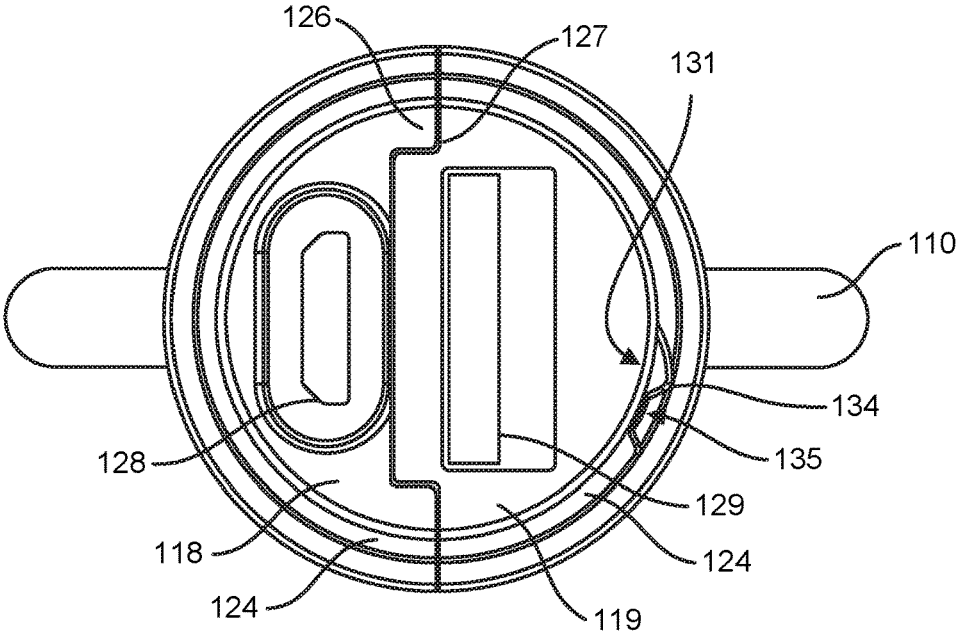
FIG. 7 illustrates a top view of the cable of the retention device of FIG. 5A.

FIG. 7 illustrates a top view of cable 110 with the cover 112 removed. First end 118 includes alignment features 126 and second end 119 includes corresponding alignment features 127 keeping first end 118 and second end 119 in position relative to each other while cover 112 is being threaded onto threads 124 of ends 118 and 119. At least one of first end 118 and second end 119 includes cable securing portion 131.

Figure 8:
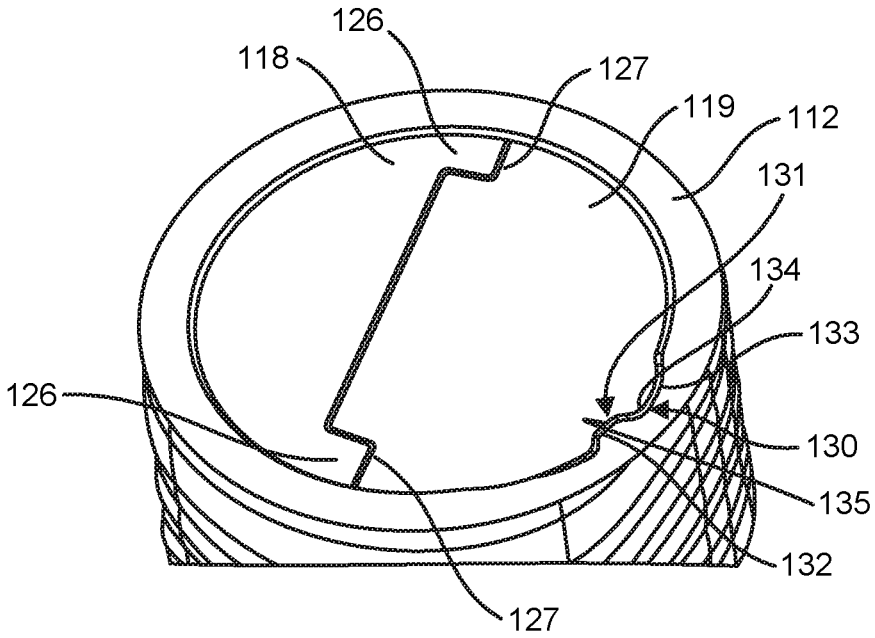
FIG. 8 illustrates a sectional view of the retention device of FIG. 5A.

FIG. 8 illustrates a sectional view of the retention device 100. An enlarged view of the cover securing portion 130 and cable securing portion 131 is shown in FIG. 9.

Figure 9:
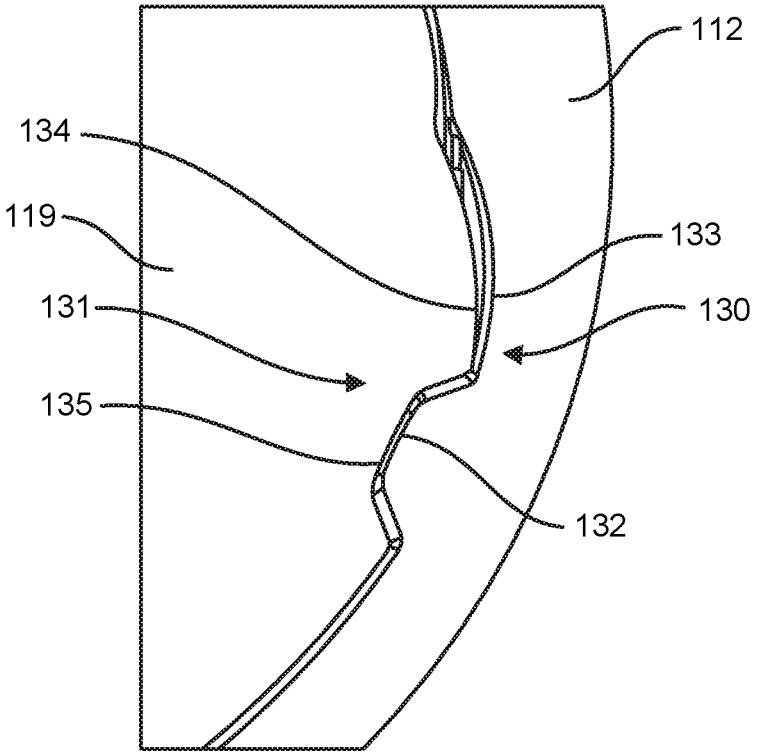
FIG. 9 illustrates an enlarged view of the détente mechanism of FIG. 8.

As can be seen in FIGS. 8 and 9, the cover securing portion 130 releasably couples to the cable securing portion 131. The cover securing portion 130 illustratively includes a first projection 132 and first recess 133. The cable securing portion 131 illustratively includes a second projection 134 and second recess 135. As illustrated in FIGS. 8 and 9, a leading edge of the projections 132, 134 and recesses 133, 135 has a relatively shallow angle, allowing for the projections 132, 134 and recesses 133, 135 to pass by each other if sufficient force is applied by a user in screwing in the first and second ends 118, 119 to cover 112.

In some exemplary embodiments, the cover 112 is formed from a resilient material, such as a plastic, polymeric, or thermoplastic material. In some exemplary embodiments, cover securing portion 130 and cable securing portion 131 form complimentary sides of a détente mechanism.

As the threads 124 of first end 118 and second end 119 are screwed into the threads 124 of cover 112, the first projection 132 is received within second recess 135 while second projection 134 is simultaneously received within first recess 133. A user receives a tactile "snap" sensation, indicating that the cover 112 has been sufficiently tightened. The user can apply a sufficient force in the opposite direction to free the projections 132, 134 from the corresponding recesses 135, 133 and unscrew cover 112 from first and second ends 118, 119.

Although cover securing portion 130 and cable securing portion 131 are each illustrated as including a projection 132, 134 and a recess 133, 135, in other embodiments, one of cover securing portion 130 and cable securing portion 131 includes multiple projections and the other includes multiple corresponding projections. In another embodiment, only one of cover securing portion 130 and cable securing portion 131 includes a projection and the other includes a corresponding recess.

Although cable securing portion 131 is illustrated as forming a portion of the threads 123 on second end 119, in other embodiments, cable securing portion 131 is formed from a portion of threads 123 first end 118. In still other embodiments cable securing portion 131 is formed from a portion of both first end 118 and second end 119. For example, in one embodiment, projection 134 is formed from a portion of first end 118 and recess 135 is formed from a portion of second end 119, and in another embodiment projection 134 is formed from a portion of second end 119 and recess 135 is formed from a portion of first end 118.

In some exemplary embodiments, at least one of cover 112, first end 118, and second end 119 includes a gasket or seal, such as a silicone gasket, to prevent water from contacting electrical contacts 128 and 129 when the cover 112 is secured over first end 118 and second end 119.

Figure 10:
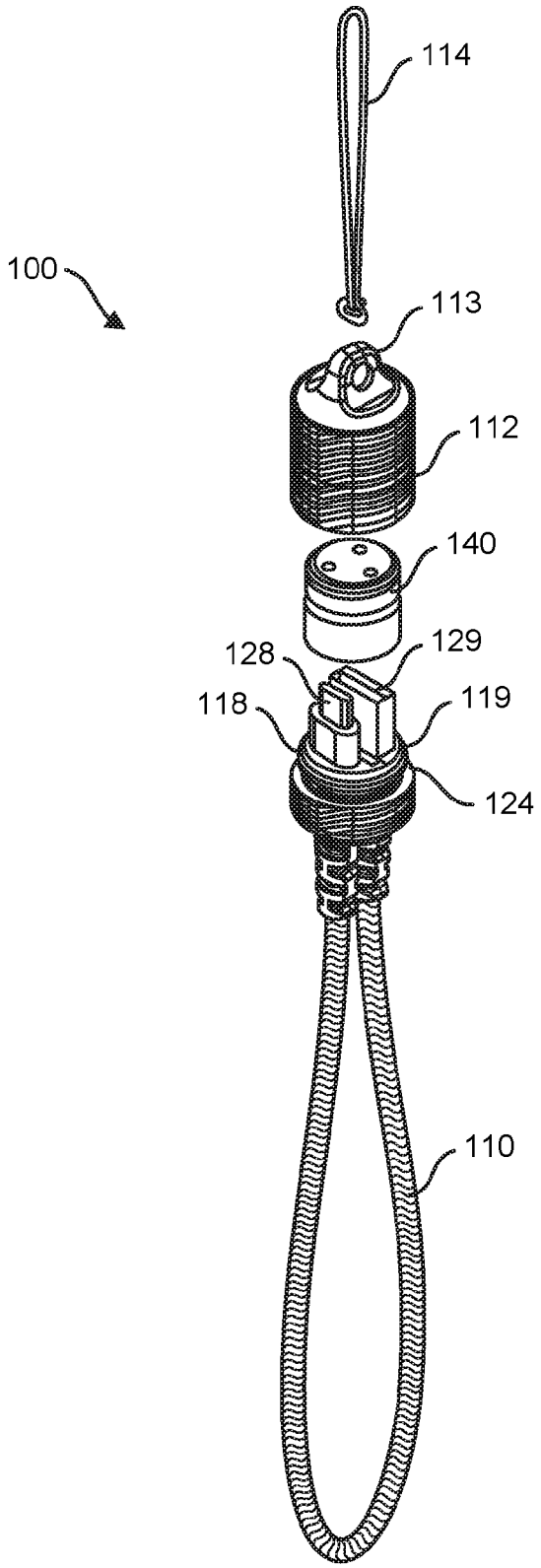
FIG. 10 illustrates an exploded view of another exemplary retention device.
Figure 11:
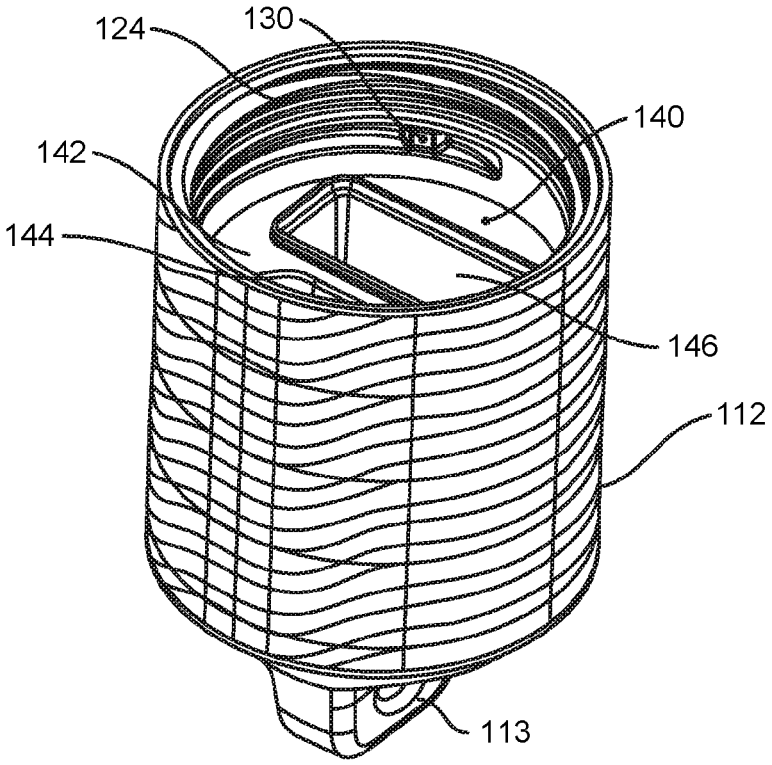
FIG. 11 illustrates the cover of the retention device of FIG. 10.
Figure 12:
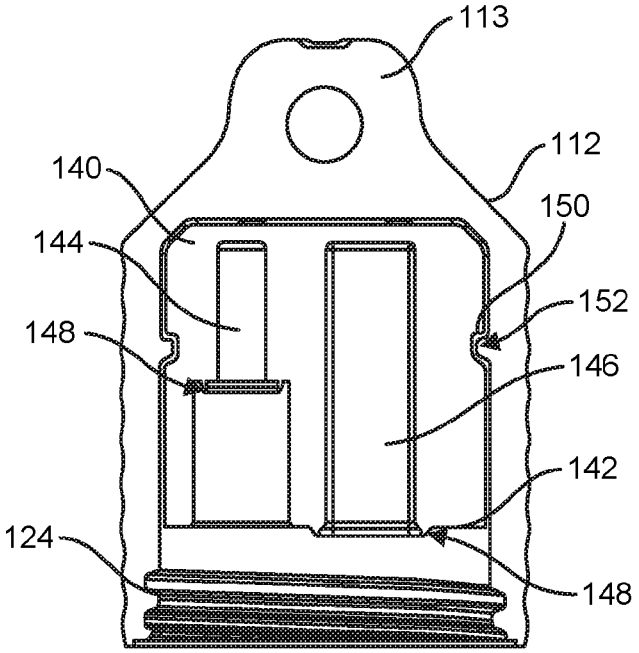
FIG. 12 illustrates a sectional view of the cover of FIG. 11.

Referring next to FIGS. 10-12, another exemplary retention device 100 is illustrated including a cable 110 and a cap or cover 112 attached to a lanyard 114 by an attachment portion 113. The cable 110 includes a first end 118 having one or more electrical contacts 128 and second end 119 having one or more electrical contacts 129. Each of first end 118 and second end 119 include threads 124 such that when first 118 and second end 119 are seated next to each other the threaded portion of each together form a complete set of threads onto which cover 112 can be threaded and removably attached. When cover 112 is threaded onto the combined ends 118 and 119, ends 118 and 119 are held in place together to form the cable 110 loop until cover 112 is removed. As shown in FIG. 11, in some embodiments the cap 112 of retention device 100 includes a cover securing portion 130 for releasably securing cap 112 to cable securing portion 131 (see FIGS. 7-9).

As shown in FIG. 10, in some embodiments retention device 100 further includes an insert 140. In some embodiments, insert 140 is formed as a portion of cap 112. In other embodiments, insert 140 is removable from cap 112. As shown in FIGS. 11 and 12, in some embodiments, insert 140 is at least partially positioned in an interior of cap 112. In some embodiments, insert 140 may be positioned entirely within an interior of cap 112, such as above internal threads 124 of cap 112. In other embodiments, threads 124 may be formed as part of insert 140. In some embodiments, insert 140 is at least partially formed from a flexible and/or elastomeric material such as silicone.

Insert 140 illustratively includes a lower surface 142 configured to contact an upper surface of first end 118 and/or second end 119. Insert 140 includes one or more cavities 144, 146 for receiving the first electrical contact 128 and/or second electrical contact 129. As shown in FIG. 12, insert 140 includes a first cavity 144 for receiving the first electrical contact 128 of first end 118 and a second cavity 146 for receiving the second electrical contract 129 of second end 119. At least one of first cavity 144 and second cavity 146 illustratively includes a sealing feature, such as gasket 148, for providing a water-resistant or water-proof seal between insert 140 and first end 118 and/or second end 119. In another exemplary embodiment (not shown), insert 140 includes a single cavity receiving both the first electrical contact 128 and/or second electrical contact 129. As shown in FIG. 12, the sealing feature 148 allows for a water-resistant or water-proof first cavity 144 or second cavity 146.

Referring to FIG. 12, insert 140 includes a retaining feature 150, configured to retain insert 140 within cap 112. In the illustrative embodiment shown in FIG. 10, retaining feature 150 comprises a recessed ring that receives a corresponding projection 152 on the interior of cap 112 to retain insert 140 within cap 112. In some embodiments, projection 152 comprises a projecting ring around an interior circumference of cap 112. In other embodiments, projection 152 comprises one or more discrete projections positioned around an interior circumference of cap 112. As illustrated in FIGS. 10 and 12, the retaining feature 150 is configured to allow rotation of the insert 140 relative to the exterior of the cap 112, allowing the cap to be screwed onto threads 124 of first end 118 and second end 119.

The elements, components, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "in other examples," "in some cases," "in some situations," "in one configuration, " "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations of the disclosed techniques may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention, except as limited by the prior art.

What is claimed is:

1. A retention device comprising:

a ruggedized electrical cable including a first electrical connector at a first end including a first threaded portion and a second electrical connector at a second end including a second threaded portion;

a cap for removably capturing the first electrical connector and the second electrical connector to form a loop from the ruggedized electrical cable, wherein the cap includes an attachment feature for attaching the cap to an object and a cap threaded portion configured to be screwed into a corresponding threaded surface comprising the first threaded portion and the second threaded portion, wherein the cap threaded portion includes a first projection and a second recess and the threaded surface includes a second projection and a first recess, the first projection and the first recess configured to form a first detent mechanism and the second projection and the second recess configured to form a second detent mechanism when the first electrical connector and the second electrical connector are captured by the cap, the first detent mechanism configured to produce a tactile sensation when the first projection is received within the first recess; and an insert configured to receive the first electrical connector and the second electrical connector of the ruggedized electrical cable, the insert configured to rotate within the cap when the cap threaded portion is screwed into the first threaded portion and the second threaded portion.

2. The retention device of claim 1, wherein the first end of the ruggedized electrical cable includes a first alignment feature and the second end of the ruggedized electrical cable includes a second alignment feature, the first and second alignment features configured to restrain the first end relative to the second end in one or more axes.

3. The retention device of claim 2, wherein the first alignment feature and the second alignment feature are configured to be completely positioned within the cap when the first electrical connector and the second electrical connector are captured by the cap.

4. The retention device of claim 1, wherein the first end and the second end are configured such that when the first end and the second end are seated next to each other the first and second threaded portions form a complete set of threads onto which the cap can be threaded and removably attached.

5. The retention device of claim 1, wherein the insert includes a first cavity sized to receive the first end of the ruggedized electrical cable and a second cavity sized to receive the second end of the ruggedized electrical cable.

6. The retention device of claim 5, wherein the insert includes a gasket configured to provide a waterproof seal between the first end and a lower surface of the insert when the first end of the ruggedized electrical cable is received within the first cavity.

7. A retention device comprising:

a ruggedized electrical cable including a first electrical connector at a first end and a second electrical connector at a second end; and a cap including a threaded interior for removably capturing the first electrical connector and the second electrical connector, wherein the threaded interior is configured to screw onto a corresponding threaded surface comprising the exterior of the first end and the exterior of the second end;

wherein the threaded interior includes a first projection and a second recess and the threaded surface includes a second projection and a first recess, the first projection and the first recess configured to form a first detent mechanism and the second projection and the second recess configured to form a second detent mechanism when the first electrical connector and the second electrical connector are captured by the cap, the first detent mechanism configured to produce a tactile sensation when the first projection is received within the first recess.

8. The retention device of claim 7, wherein the first end includes a first alignment feature and the second end includes a corresponding second alignment feature configured to receive the first alignment feature.

9. The retention device of claim 7, wherein the second projection and the first recess are formed on the first end of the ruggedized electrical cable.

10. The retention device of claim 7, wherein the second projection is formed on the first end of the ruggedized electrical cable and the first recess is formed on the second end of the ruggedized electrical cable.

11. The retention device of claim 7, further comprising an insert having a first cavity sized to receive at least a portion of the first electrical connector.

12. The retention device of claim 11, wherein the insert further includes a second cavity sized to receive at least a portion of the second electrical connector.

13. The retention device of claim 11, wherein the insert includes a gasket configured to provide a waterproof seal between the first end and a lower surface of the insert when the first electrical connector is received within the first cavity.

14. The retention device of claim 11, wherein the insert is configured to rotate within the cap.

15. The retention device of claim 11, wherein the insert comprises silicone.

16. A cable for transferring an electric signal, the cable comprising:

a first end with a first threaded portion, a first alignment feature, and a first electrical connection, the first end having a substantially semi-circular cross-section;

a second end electrically coupled to the first end, the second end having a second threaded portion, a second alignment feature, and a second electrical connection, the second end having a substantially semi-circular cross-section; and a cap having a circular cross-section and a threaded interior;

wherein the cable has a first configuration in which the first end is configured to be electrically coupled to a first external receiver and the second end is configured to be electrically coupled to a second external receiver, the first alignment feature being spaced apart from the second alignment feature in the first configuration;

wherein the cable has a second configuration in which the threaded interior of the cap is removably coupled to the first and second threaded portions of the cable, the first end and the second end being positioned in an interior of the cap and the first alignment feature being adjacent to the second alignment feature in the second configuration, the first threaded portion and the second threaded portion forming a circular threaded portion having a circular cross-section in the second configuration, the threaded portion having a circular set of threads formed from the first threaded portion and the second threaded portion, the circular set of threads being configured to removably couple the cable to the threaded interior of the cap; and wherein the threaded interior includes a first projection and a second recess and the circular threaded portion includes a second projection and a first recess, the first projection and the first recess configured to form a first detent mechanism and the second projection and the second recess configured to form a second detent mechanism when the cable is coupled to the cap, the first detent mechanism configured to produce a tactile sensation when the first projection is received within the first recess.

17. The retention device of claim 1, wherein the cap includes one or more projections positioned around an interior circumference of the cap and the insert includes a recessed ring configured to receive the one or more projections positioned around an interior circumference of the cap to allow the rotation of the insert relative to an exterior of the cap.

18. The retention device of claim 5, wherein the first cavity and the second cavity of the insert are configured to rotate within the cap as the cap threaded portion is screwed into the first threaded portion and the second threaded portion of the ruggedized electrical cable.

19. The retention device of claim 7, wherein the first recess is formed in one of a thread extending outwardly from the threaded surface and a thread extending inwardly from the threaded interior.

20. The retention device of claim 7, wherein the cap comprises a resilient material, each of the first projection and the second projection including a leading edge comprising an angle configured to allow the first projection to pass by the second projection upon application of a sufficient force when the first electrical connector and the second electrical connector are captured by the cap.

21. The retention device of claim 1, wherein the cap comprises a resilient material, each of the first projection and the second projection including a leading edge comprising an angle configured to allow the first projection to pass by the second projection upon application of a sufficient force when the first electrical connector and the second electrical connector are captured by the cap.

* * * * *